US006890123B2

(12) United States Patent
Piccoli

(10) Patent No.: US 6,890,123 B2
(45) Date of Patent: May 10, 2005

(54) DEVICE FOR FORMING TIGHT RADIUS CURBS AND GUTTERS WITH A PAVING MACHINE

(75) Inventor: Mario Piccoli, London (CA)

(73) Assignee: N. Piccoli Construction, London (GB)

( * ) Notice: Subject to any disclaimer, the term of this patent is extended or adjusted under 35 U.S.C. 154(b) by 0 days.

(21) Appl. No.: 10/359,228

(22) Filed: Feb. 6, 2003

(65) Prior Publication Data

US 2003/0180092 A1 Sep. 25, 2003

Related U.S. Application Data

(60) Provisional application No. 60/354,269, filed on Feb. 6, 2002.

(51) Int. Cl.[7] ..... E01C 11/22

(52) U.S. Cl. ..... 404/72; 404/98; 404/101; 404/108; 180/442

(58) Field of Search ..... 404/72, 98, 101, 404/105, 108, 104, 112; 180/403, 408, 414, 442

(56) References Cited

U.S. PATENT DOCUMENTS 3,606,827 A * 9/1971 Miller et al. ..... 404/84.2
3,710,695 A * 1/1973 Miller et al. ..... 404/98
3,749,505 A * 7/1973 Miller et al. ..... 404/98
3,936,211 A * 2/1976 Miller et al. ..... 404/104
4,029,165 A * 6/1977 Miller et al. ..... 180/6.48
4,093,410 A * 6/1978 Miller ..... 425/59
4,140,193 A * 2/1979 Miller ..... 180/9.46
D252,274 S * 7/1979 Gregorich et al. ..... D15/24
4,185,712 A * 1/1980 Bulger ..... 180/401
4,197,032 A * 4/1980 Miller ..... 404/98
4,319,859 A * 3/1982 Wise ..... 405/268
4,360,293 A * 11/1982 Wade ..... 405/268
4,391,549 A * 7/1983 Murray ..... 404/87
4,789,266 A * 12/1988 Clarke et al. ..... 404/96
4,984,932 A * 1/1991 Leone ..... 404/72
5,662,431 A * 9/1997 Colvard ..... 404/105
6,286,615 B1 * 9/2001 Bitelli ..... 180/9.46
6,351,899 B1 * 3/2002 Slutzky ..... 37/223
6,471,442 B1 * 10/2002 Deeb et al. ..... 404/96
6,481,924 B1 * 11/2002 Smolders et al. ..... 404/105
6,582,152 B2 * 6/2003 Leone et al. ..... 404/75
6,692,185 B2 * 2/2004 Colvard ..... 404/105

* cited by examiner

*Primary Examiner*—Gary S. Hartmann
(74) *Attorney, Agent, or Firm*—Marks & Clerk; Richard J. Mitchell

(57) ABSTRACT

A system and method to allow a paving machine to form tight radii in continuous extrusions such as curbs and gutters is disclosed. A shift cylinder is used with the steering mechanism of a typical paving machine to allow sharp radius turns. The steering cylinder is used to pivot the track of the paving machine about its leg and the steering cylinder is used to pivot the leg relative to the frame of the paving machine. A hydraulic circuit is operator activated to allow fluid flow through a flow divider to ensure each cylinder operates in concert.

7 Claims, 17 Drawing Sheets

DEVICE FOR FORMING TIGHT RADIUS CURBS AND GUTTERS WITH A PAVING MACHINE

CROSS-REFERENCE TO RELATED APPLICATION

This application claims the benefit of U.S. Provisional Application No. 60/354,269 filed Feb. 6, 2002.

FIELD OF THE INVENTION

The present invention relates to construction equipment and more particularly to a system and method to allow a paving machine to form tight radii in continuous extrusions such as curbs and gutters.

BACKGROUND OF THE INVENTION

In road construction, the placement of paving material involves a paving machine for distributing the aggregate, asphalt, or concrete uniformly and to the required thickness, shape, and width (typically, one or two traffic lanes). As the paving machine traverses the road, it screeds the granular road base surface, and also forms curbs and gutters.

Typically, paving machines are large, bulky machines difficult to maneuver. While such machines generally work for their intended purpose, they fail to permit the forming of tight radius curbs and gutters. Most paving machines only allow for 10 ft to 15 ft radii to be formed. Producing smaller radii, such as 2 ft to 6 ft radii, reduces the requirement for hand forming, resulting in higher production, especially in areas of many tight radii such as parking lots.

Therefore, it would be desirable to provide a device for a paving machine that would permit for the forming of tight radii.

SUMMARY OF THE INVENTION

A system and method to allow a paving machine to form tight radii in various continuous extrusions is disclosed.

According to one aspect of the invention, there is provided a curb forming machine comprising a frame, at least three leg assemblies for moving the machine, each leg assembly having a leg and a track mounted to the leg, a hopper carried by the frame, the hopper including an opening for receiving curb forming material, a slipform in communication with the hopper for receiving the curb forming material from the hopper for forming a curb, and a positioning arrangement for positioning a corresponding leg assembly to form a tight radius, wherein the positioning arrangement comprises means to rotate the track about the leg, and means to rotate the leg relative to the frame.

According to another aspect of the invention, there is provided, in a curb forming machine comprising a frame with at least three leg assemblies for moving the machine, each leg assembly having a leg and a track mounted to the leg, a hopper carried by the frame, the hopper including an opening for receiving curb forming material, and a slipform in communication with the hopper for receiving the curb forming material from the hopper for forming a curb, a method for a leg forming a tight radius, the method comprising the steps of rotating the track about the leg, and rotating the leg relative to the frame.

By controlling a separate shift cylinder for at least one leg, it is possible to provide for better maneuverability of the leg to achieve a tighter radius, thus resulting in higher productivity. By controlling the oil flow to the steering cylinder to be equally distributed to both the steering cylinder and the shift cylinder for each leg, both cylinders are able to move in concert resulting in a smooth operation.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

Similar references will be used to denote similar components.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Figure 1:
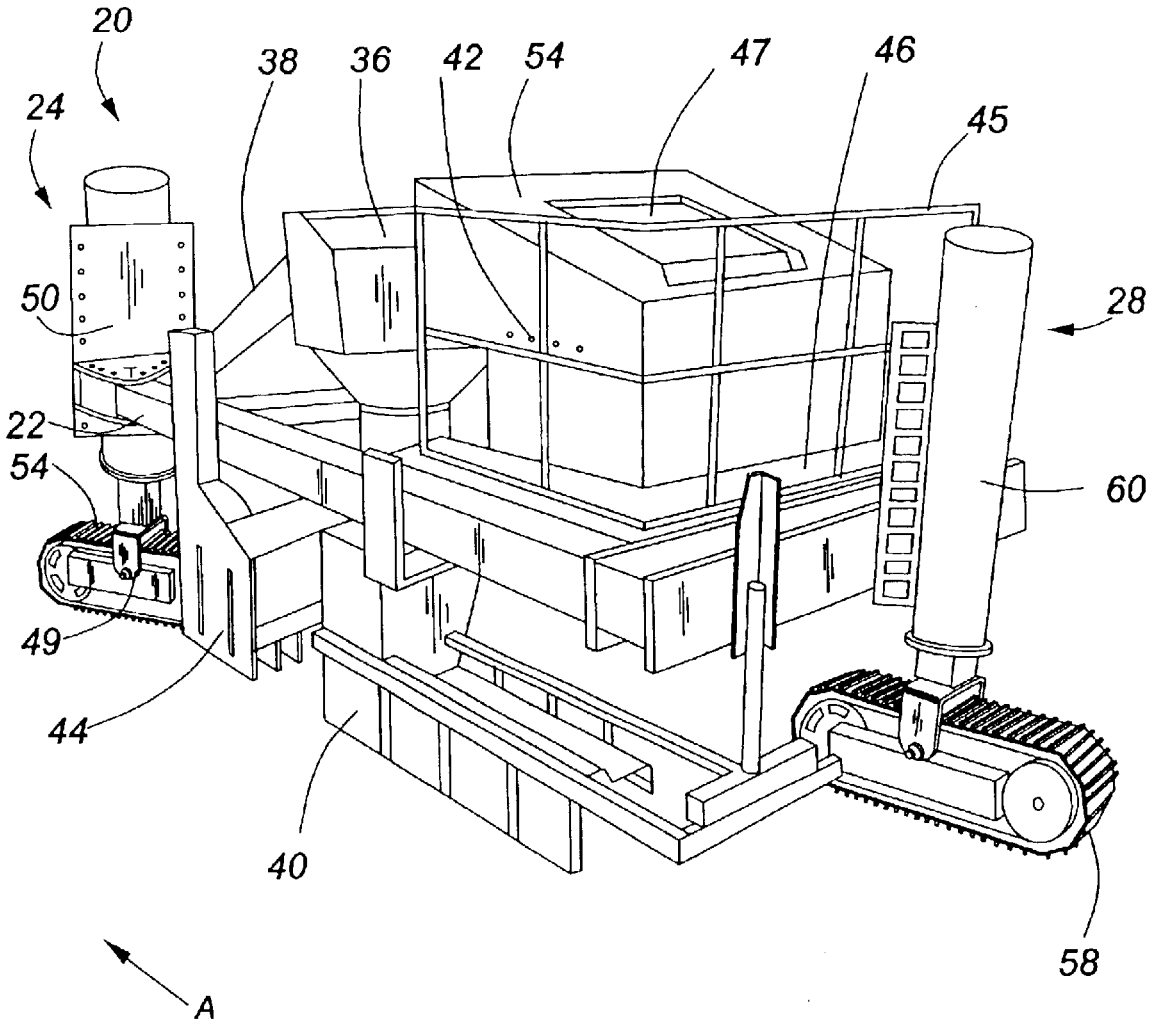
FIG. 1 illustrates a perspective view of a typical paving machine.

Referring to FIG. 1, there is illustrated a typical paving machine 20. Paving machine 20 includes a main frame 22 supported on vertically adjustable upright leg assemblies, preferably represented by at least a first front leg assembly 24, a second front leg assembly (not seen), and a rear leg assembly 28. Generally, machine 20 is self-propelled by moveable ground engaging means mounted to the leg assemblies, preferably in the form of wheels with tracks having a continuous belt. The leg assemblies are preferably independently controlled as is described below.

In another embodiment, the paving machine 20 is propelled by a prime mover (not shown). The prime mover may be a tractor comprising tracks. In other embodiments, other types of tractor wheels may be used.

The paving machine 20 supports the various paving machine components. A receiving hopper 36 receives a formable, hardenable paving material such as concrete from the chute of a concrete mixing truck (not shown) via a conveyor belt 38. The receiving hopper 36 is also connected to a working unit 40 or mold such as a slip form. The concrete fed into the receiving hopper 36 will flow by gravity with the aid of vibrators (not shown) within slip form 40 into the slip form 40 and will be discharged or poured onto the roadway. Vibrator control panel 42 controls the amount of vibration output by the vibrators (not shown). The working unit 40 utilizes the concrete supplied from the receiving hopper 36 to lay a curb or gutter in the desired shape according to its design.

As the paving machine 20 traverses the roadway in the direction indicated by arrow A, a forward trimmer 44 functions conventionally to level the granular road base to a desired elevation. Hydraulic cylinders (not shown) or any other suitable means can be used to move the screed to a selected operating elevation.

An operator's platform 46 is located such to provide a clear view of the incoming concrete, and the slip form. Portions of the deck on the frame may be covered so that the operator can see the slip form and concrete but yet can walk across the areas. A rail 45 may be provided around platform 46 for safety.

The operator's cab 47 is provided for a self-propelled paving machine. In the case of a paving machine propelled by a prime mover, the cab is located within the prime mover itself.

Embodiments of the invention relate to a system to modify the steering mechanism of a typical curb-forming machine to allow for much sharper turns and tighter radii on continuous extrusions.

The machine 20 has three leg assemblies in total represented by first front leg assembly 24, a second front leg assembly (not seen), and a rear leg assembly 28, with each leg assembly having an associated steering cylinder. Each leg assembly comprises a ground engaging track, the first front track 49 being mounted to a hydraulic power-swing leg 50, the second front track (not shown) being mounted to a hydraulic telescoping leg (not shown), and the rear track 58 being mounted to a power-slide leg 60. The second front leg assembly and the rear leg assembly operate in a conventional manner. Therefore, only the front first leg assembly 24 is further described and illustrated.

Figure 2:
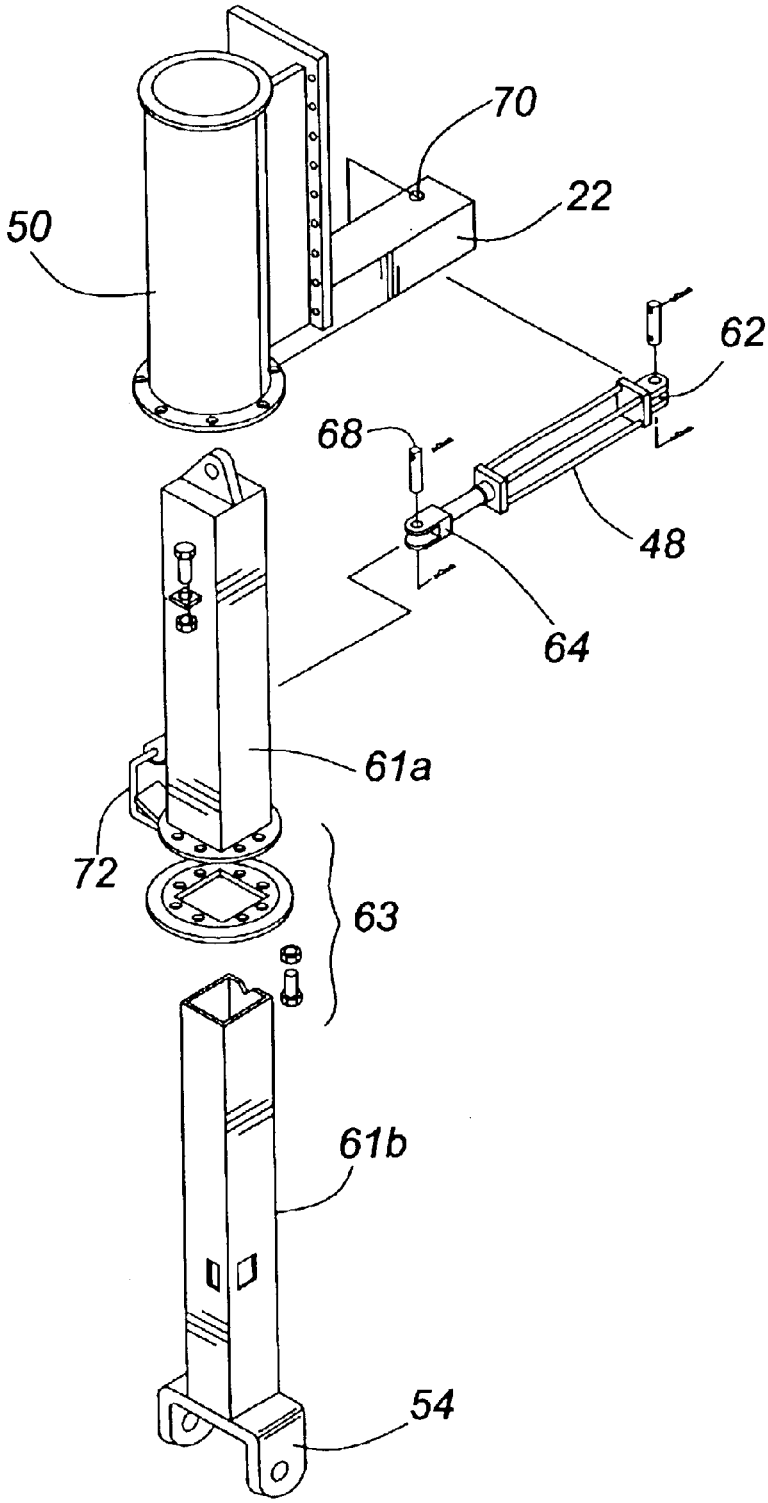
FIG. 2 is an exploded view of the front leg assembly of FIG. 1.

Referring to FIG. 2, a first inner tube 61*a* is positioned within leg 50 via a brass plate bushing assembly 63. The first inner square tube 61*a* rotates within leg 50. The second inner tube 61*b* is mounted to the track 49 by clevis 54, such that when both tubes 61*a* and 61*b* rotate, the track 49 is turned. In a preferred embodiment, each leg has two inner tubes.

Figure 3:
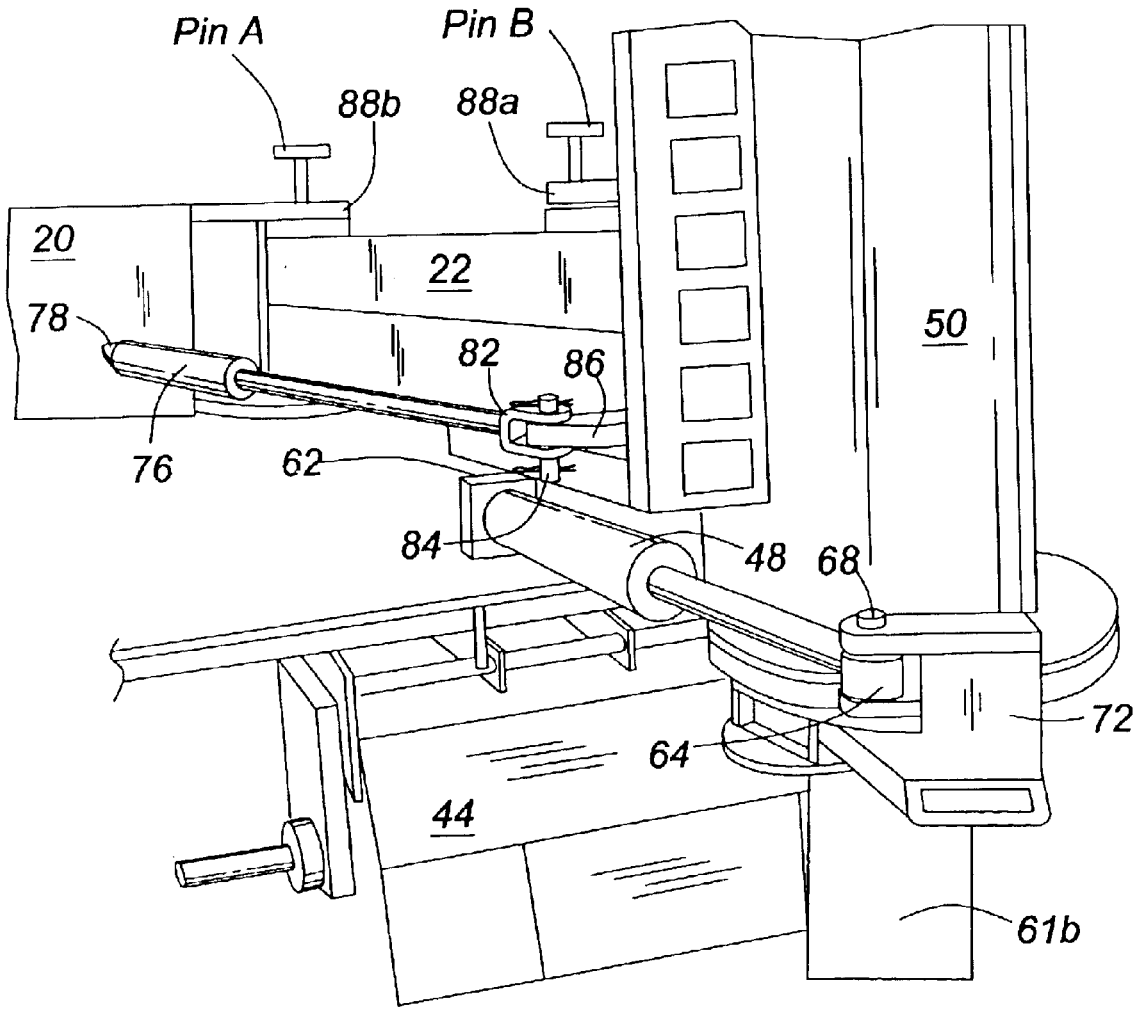
FIG. 3 illustrates the mounting of the front leg assembly of FIG. 2.
Figure 4A:
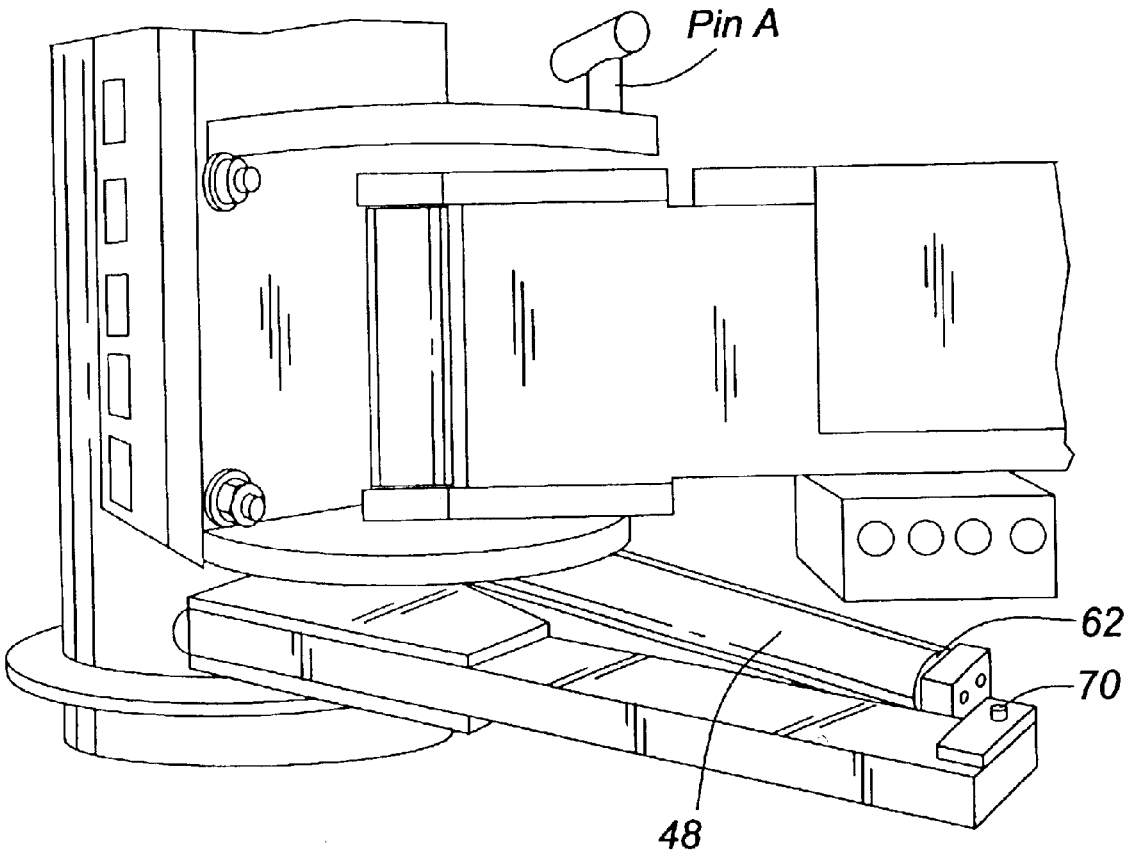
FIG. 4*a* illustrates the mounting of the cylinder end of the steering cylinder.

Referring to FIG. 3, the cylinder end 62 of the steering cylinder 48 is pivotally mounted about a pivot pin 70 to leg 50 (as seen in FIGS. 2 and 4*a*). The rod end 64 of the steering cylinder 48 is pivotally mounted on pivot pin 68 that passes through rotating assembly 72 on the rod of the inner tube for rotation, which in turn, rotates the track. The two pivot points provided by the pivot pins 70 and 68 allow the positioning of the track 49.

Figure 4B:
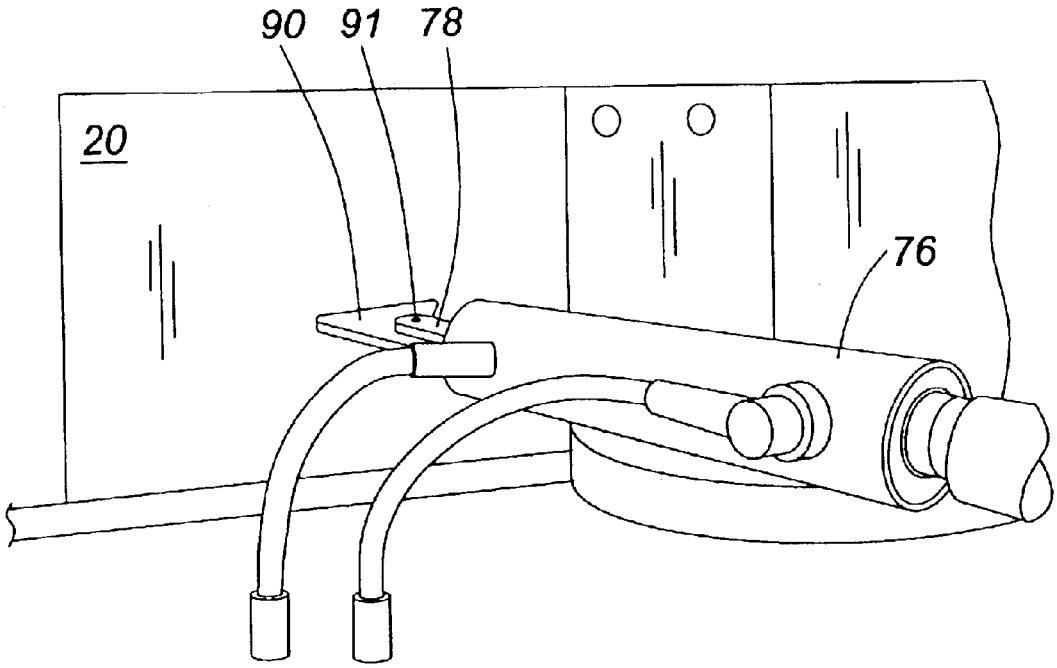
FIG. 4*b* illustrates the mounting of the cylinder end of the shift cylinder.

Referring to FIG. 4*b*, a shift cylinder 76 is also associated with at least the first front leg assembly 24. The cylinder end 78 of the shift cylinder 76 is pivotally mounted about pin 91 to lug 90, which is welded to the machine 20. The rod end 82 of the shift cylinder 76 is pivotally mounted on pivot pin 84 that passes through lug 86, which is welded to leg 50 (as seen in FIG. 3).

Shift cylinder 76 is used primarily to change the configuration of the machine by repositioning the leg assembly 24 relative to the frame. This shift cylinder 76 is used in the present invention to allow for tighter radii to be formed as is described below.

Figure 5:
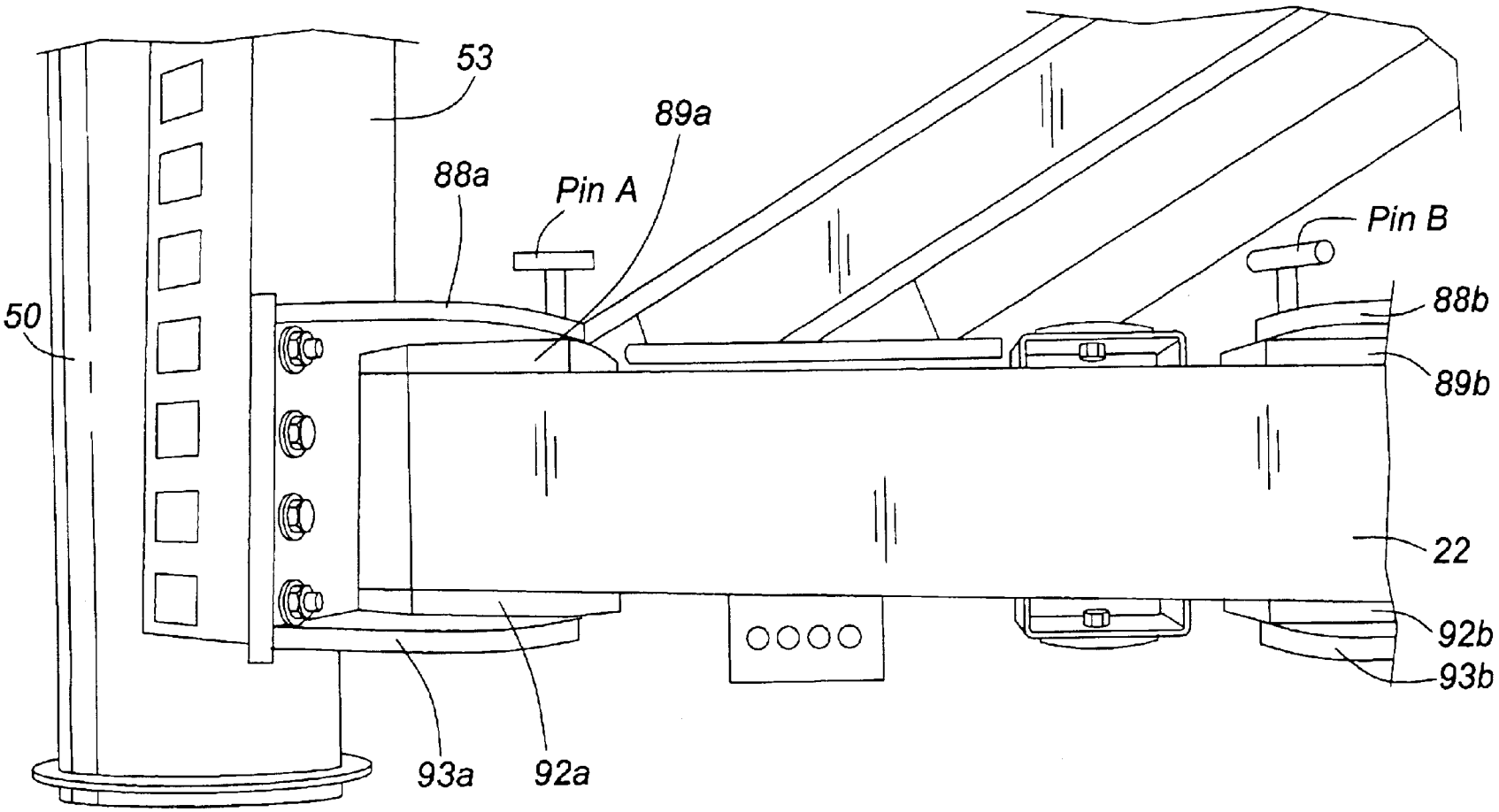
FIG. 5 illustrates the locations of locking pins A and B in a conventional radius position.

Referring to FIG. 5, the machine 20 includes locking pins A and B used to achieve the formation of tighter radii. Pin A slides through a hole (not shown in FIG. 5) in the top bracket 88*a* (semi circular in shape as seen in a top view) that is bolted to the back 53 of the outer tube 50. Then pin A goes through a hole (not shown in FIG. 5) in the upper portion 89*a* of the frame 22 and exits a hole (not shown) in the lower part 92*a* of that same frame 22. Pin A then goes through a hole (not shown in FIG. 5) in the lower bracket 93*a* (semi circular in shape as seen in a top view) that is bolted to the back 53 of the outer tube 50. When pin A is inserted, it prevents the outer tube 50 from rotating.

Pin B slides through a hole (not shown in FIG. 5) in the top bracket 88*b* (semi circular in shape as seen in a top view) that is bolted to the machine 20. Then pin B goes through a hole (not shown in FIG. 5) in the upper portion 89*b* of the frame 22 and exits a hole (not shown in FIG. 5) in the lower part 92*b* of frame 22. The pin B then goes through a hole (not shown in FIG. 5) in the lower bracket 93*b* (semi circular in shape as seen in a top view) that is bolted to the main frame 22 of the machine. When the pin B is inserted, it prevents frame 22 from moving.

The locking pins A and B lock the leg 50 and the front frame 22 in place. When both pins A and B are in place, only the steering cylinder 48 operates to pivot the track 49 about the leg 50.

Figure 7:
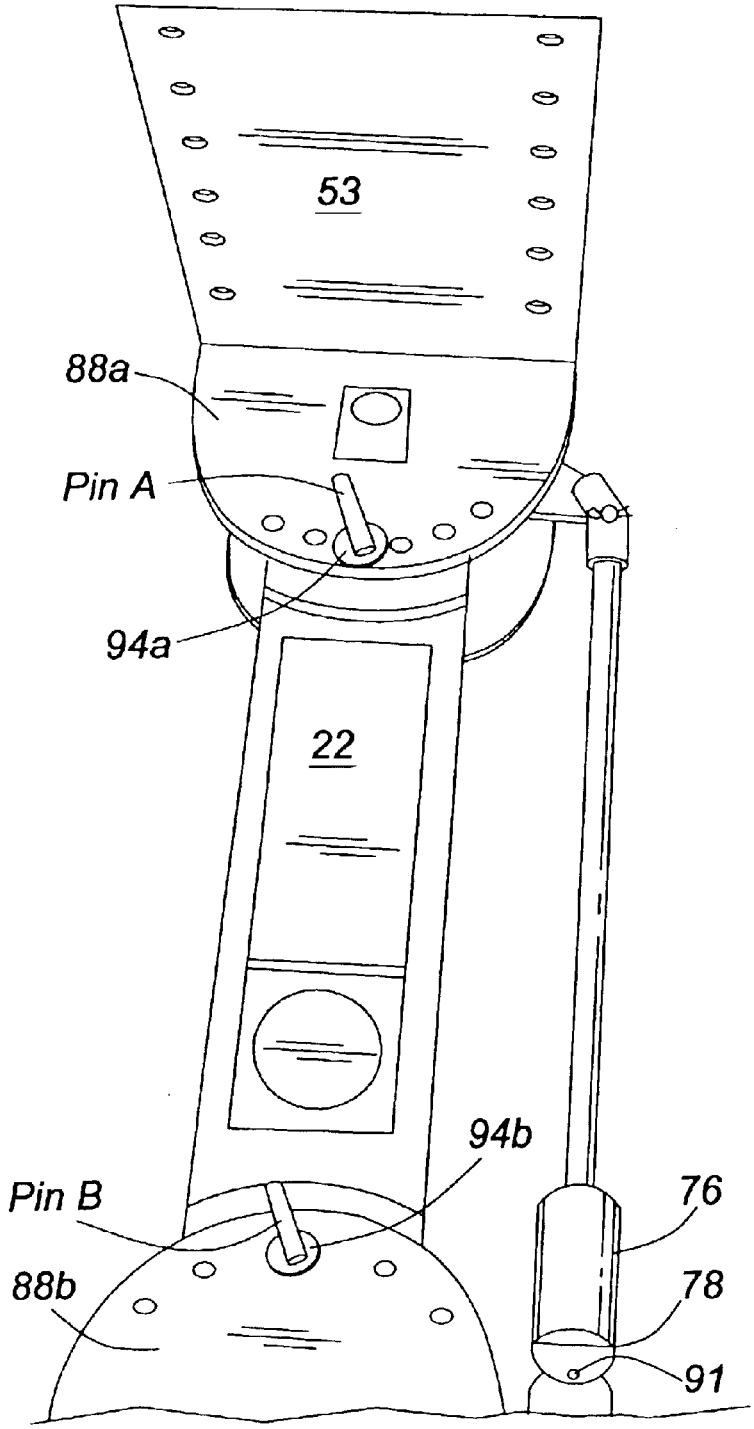
FIG. 7 illustrates a top view of FIG. 6.

FIG. 7 shows the position of the frame 22 and the leg 50 in their normal operating position; pins A and B are inserted in the center or middle hole 94*a*, 94*b* of the semicircle mounts 88*a*, 88*b*, 93*a* and 93*b*, respectively.

Figure 9:
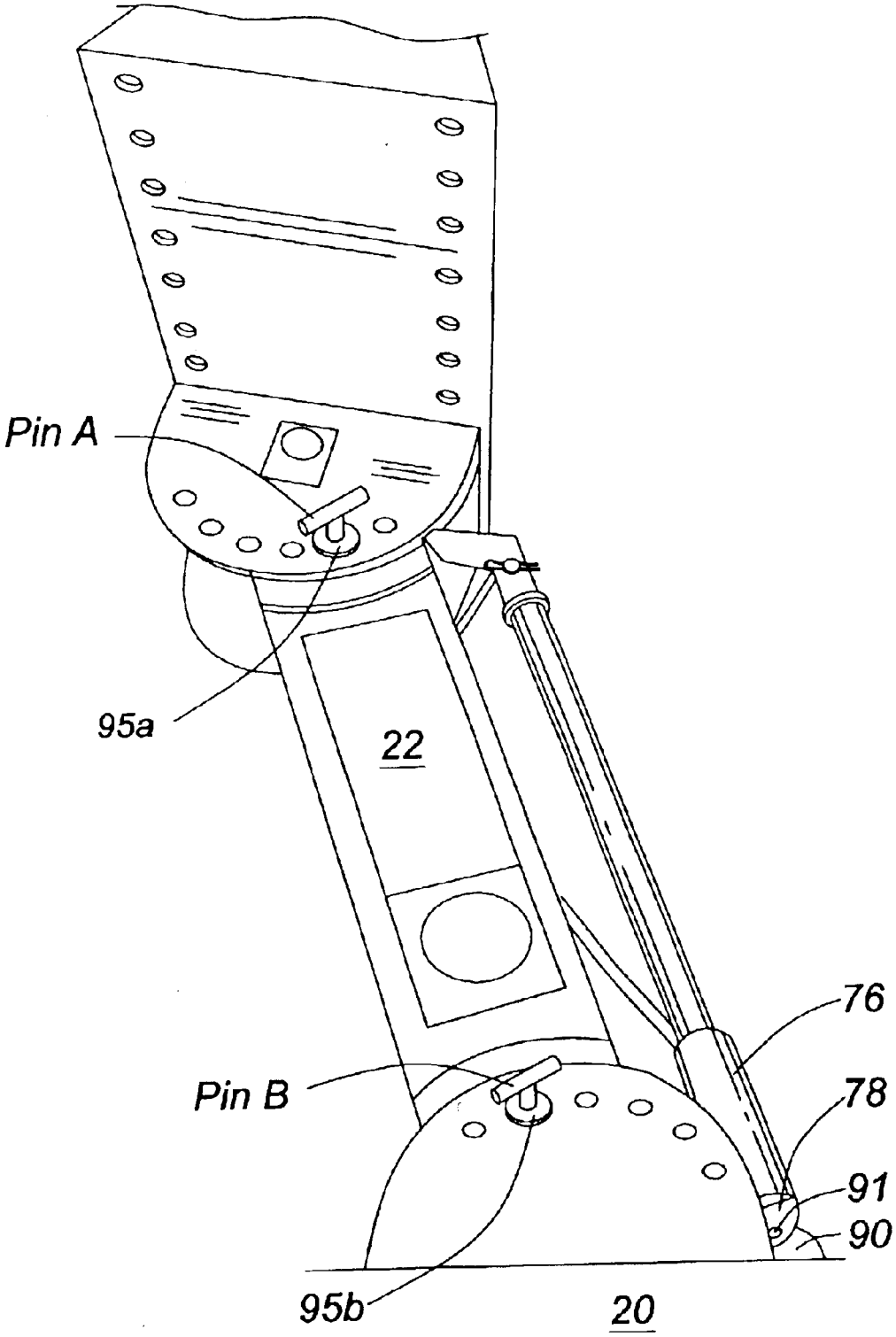
FIG. 9 illustrates a the position of the leg of FIG. 2 in an offset operating system.

FIG. 9 shows the position of the frame 22 and the leg 50 in an offset operating position. This position is desirable when avoiding obstructions the front track 49 would have encountered if it was in its normal position. This position is achieved by removing pin B and extending the shift cylinder 76 to align the holes in the new position. Pin B is inserted through hole 95*b*, and then pin A is removed and the shift cylinder 76 is retracted to align the holes in the new position. Pin A is then inserted through hole 95*a*. With both pins reinserted in their new positions, frame 22 and leg 50 are secured in this configuration.

Figure 6:
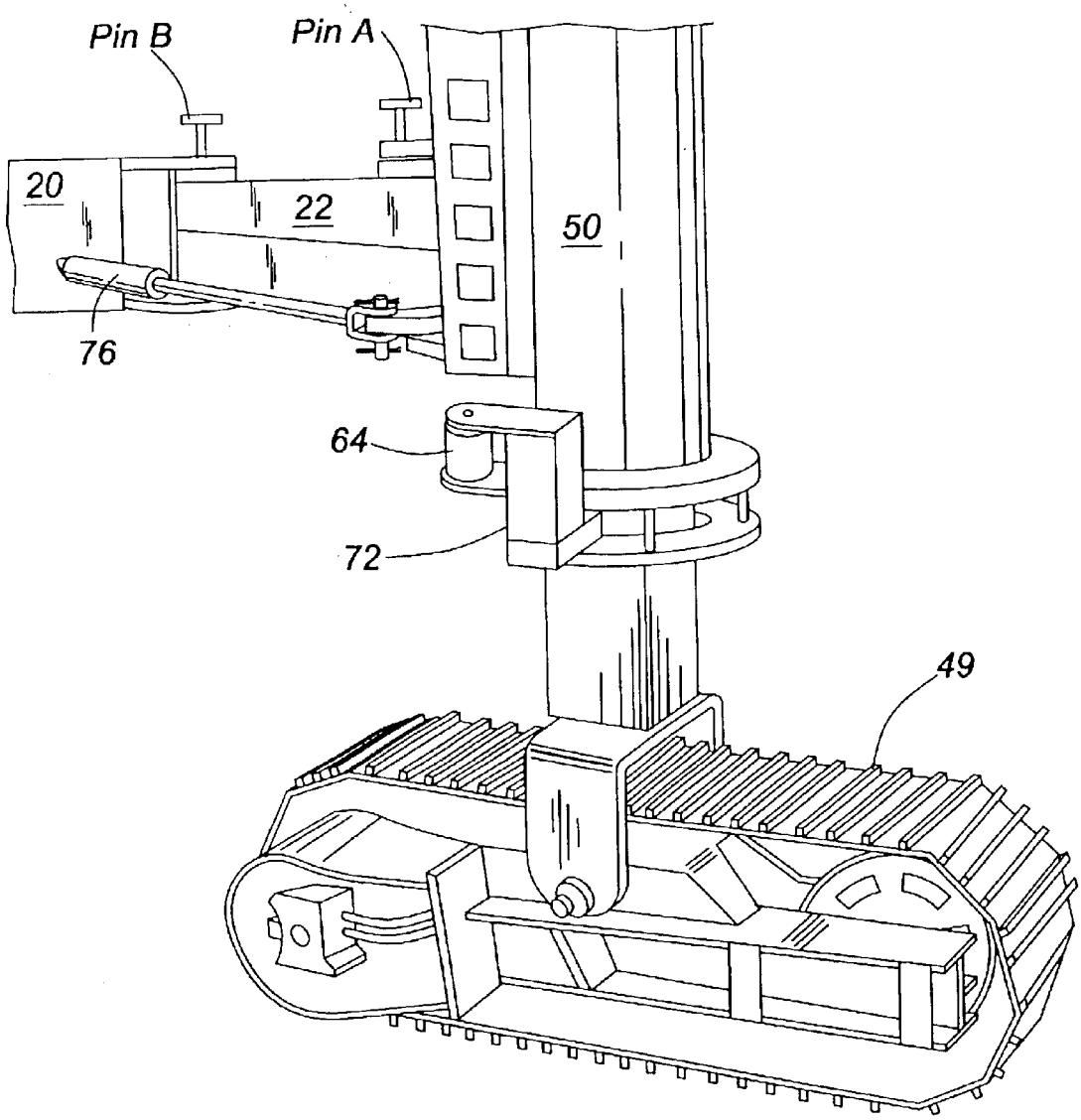
FIG. 6 illustrates a conventional position of the leg of FIG. 2 when forming a radius.

FIG. 6 shows the position of track 49 in a normal radius turn. By removing pin A, and extending the shift cylinder 76 (FIG. 9), a much sharper or tighter turn is possible as shown in FIG. 8. If locking pin A is not inserted in hole 95*a*, then leg 50 is free to rotate as called for by the circuit in FIG. 11 (as described in detail below).

Figure 10:
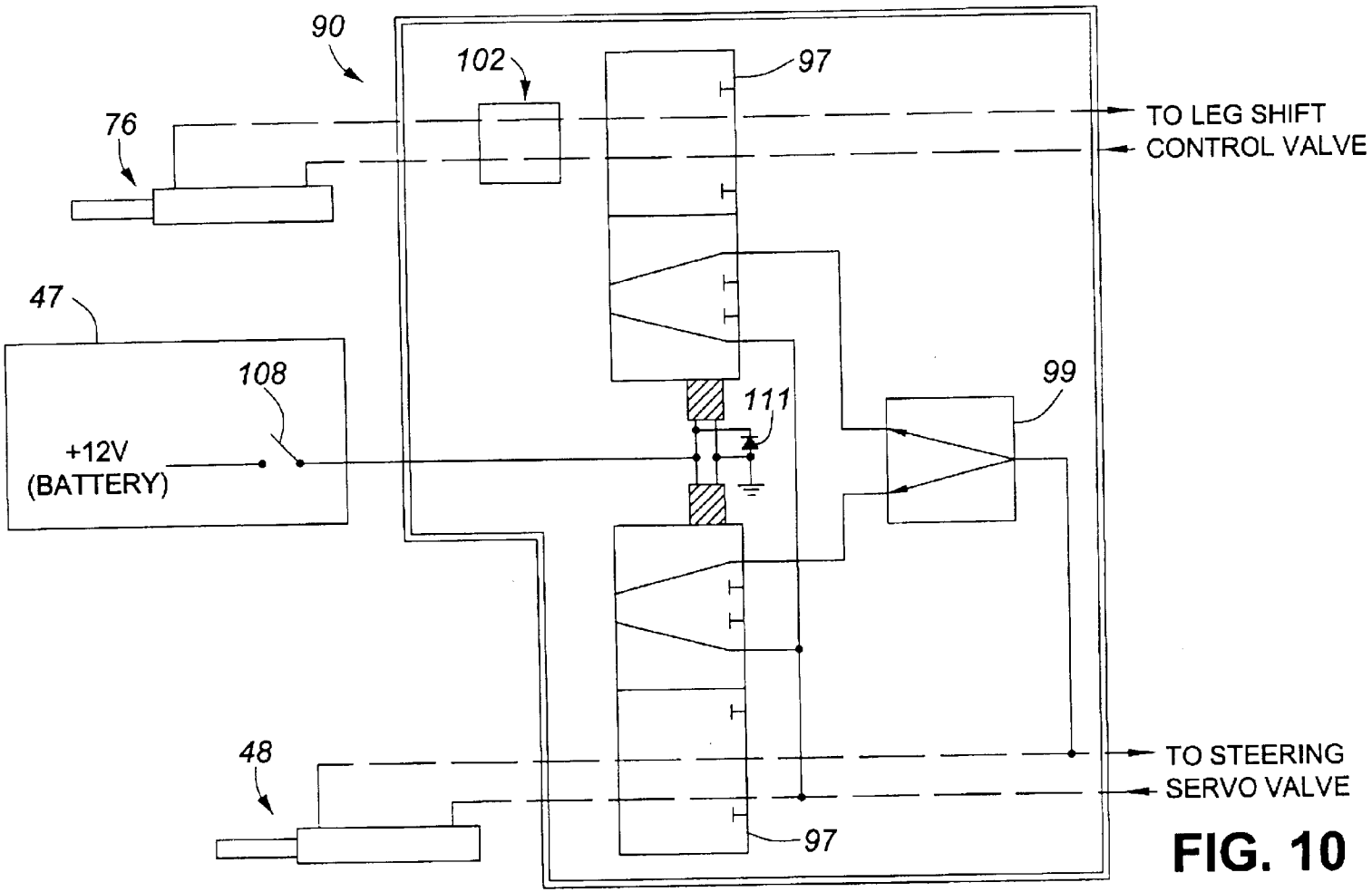
FIG. 10 illustrates a schematic of a hydraulic circuit of a leg positioned as seen in FIG. 6.

Referring to FIG. 10, the hydraulic circuit 90 added to the machine 20 is illustrated with the path of the oil for the position of FIG. 6 marked with a dash line. A hydraulic pump (not shown) draws hydraulic fluid, preferably oil, from the hydraulic tank (not shown) through a steering servo valve and to the steering cylinder 48 and shift cylinder 76. It can be seen that the oil does not flow through the flow divider 99 as the double selector valves 97 block it. In this operation, the steering cylinder 48 will steer the machine 20 in a conventional manner and the shift cylinder 76 can be used only to shift the leg 50 and the frame 22 into an offset position if required (when the locking pins A and B are removed as described above).

Figure 11:
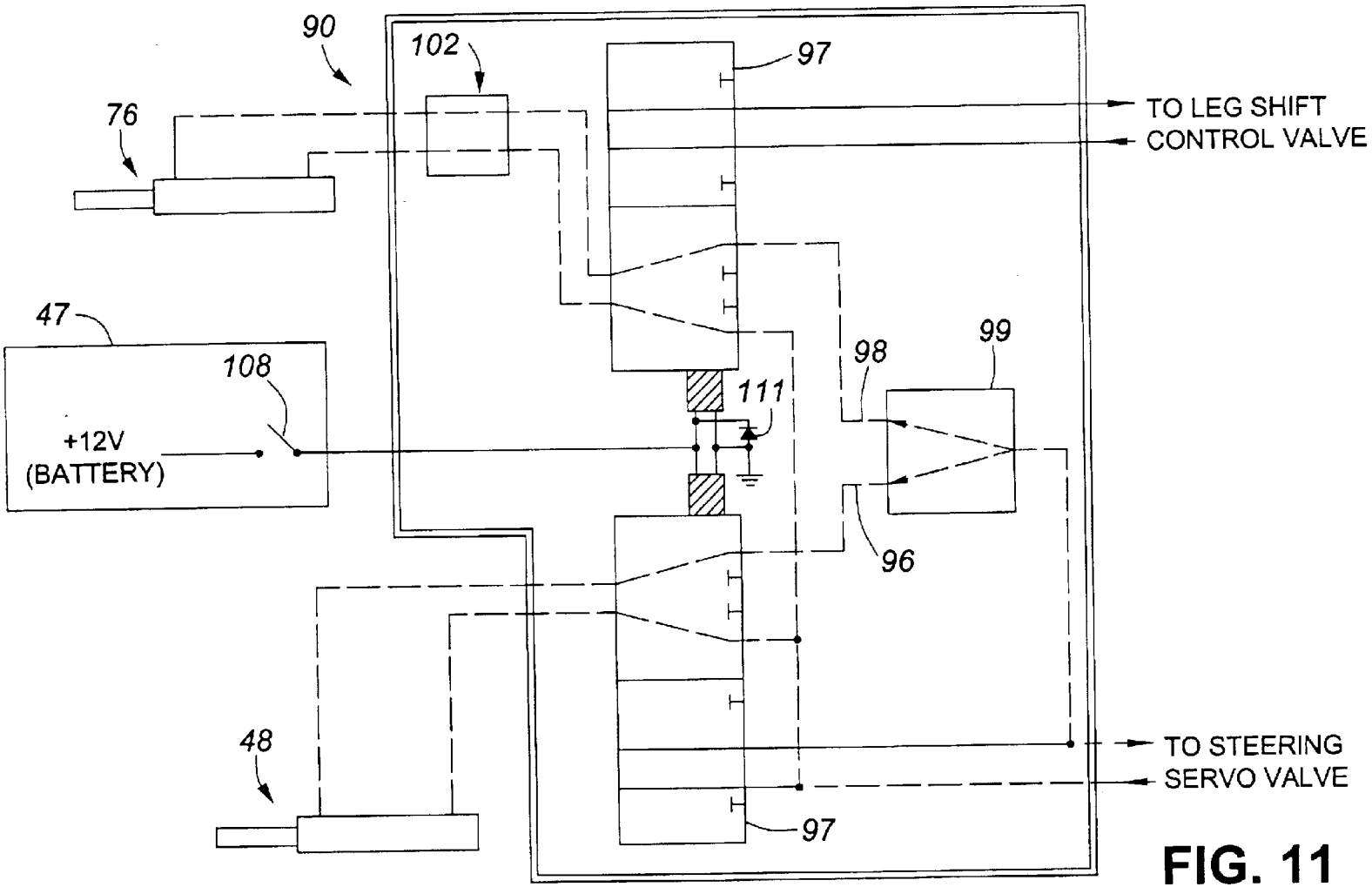
FIG. 11 illustrates one embodiment of a schematic of a tight radius hydraulic circuit of a leg positioned as seen in FIGS. 8*a* and 8*b;*

Referring to FIG. 11, in accordance with the present invention, the leg assembly 24 is positioned to form a tighter radius than that of FIG. 6. The hydraulic circuit 90 added to the machine 20 in this position is seen in FIG. 8. A hydraulic pump (not shown) draws the oil from the hydraulic tank (not shown) through a steering servo valve and it can be seen that the oil that feeds the steering cylinder 48 is split into two equal flows 96, 98. The first flow 96 goes to the steering cylinder 48 and the second flow 98 to the shift cylinder 76. The two flows 96, 98 extend both cylinders 48, 76 simultaneously to the position leg 50 and track 49 as seen in FIG. 8. During operation, the flow divider valve 99 ensures that equal flow is provided to each cylinder 48, 76, allowing for each cylinder 48, 76 to extend and retract in concert, providing smooth operation. Switch 108 in cab 47 allows the operator to control the operation of the circuit 90.

Figure 8A:
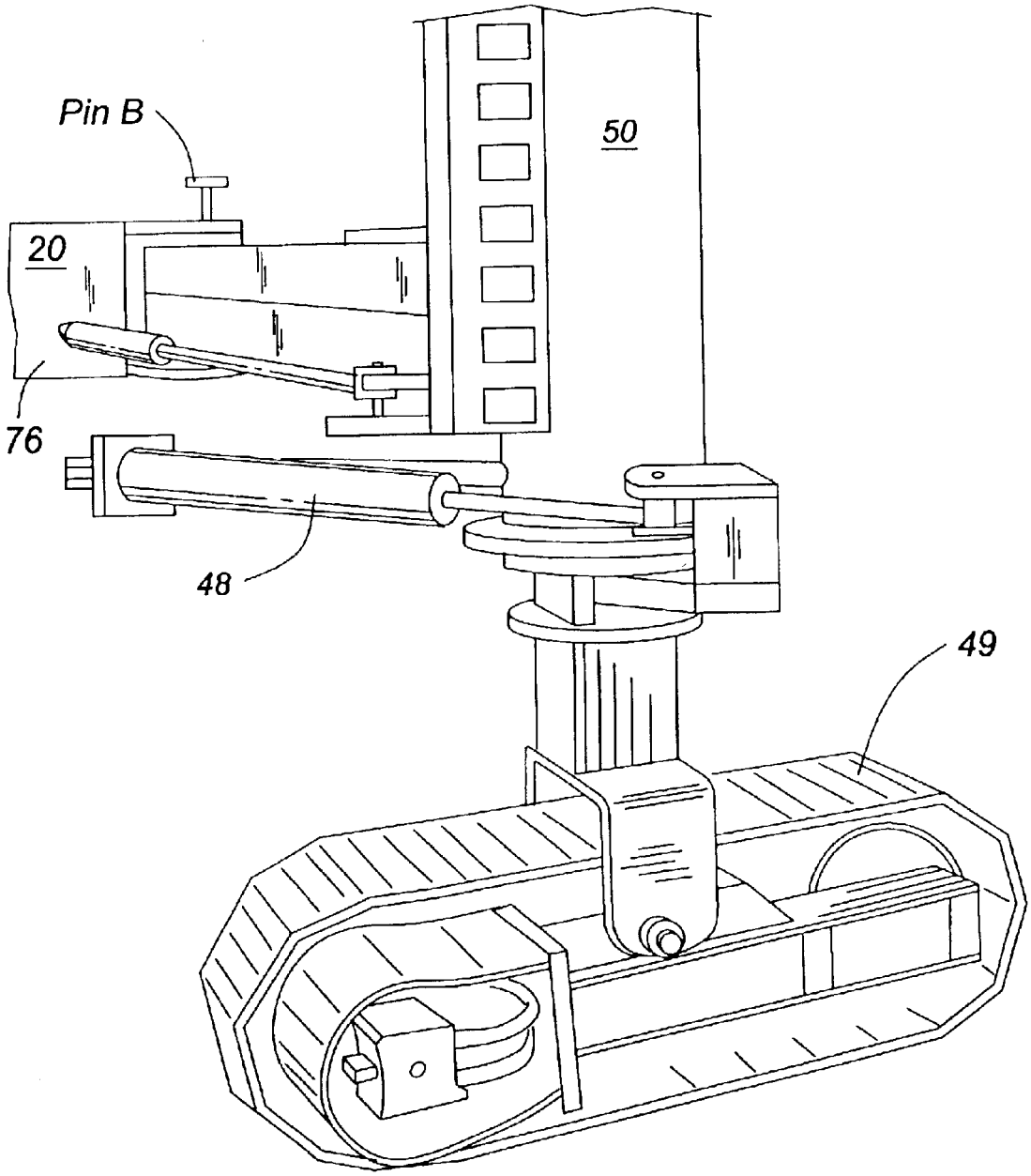
FIG. 8*a* illustrates the position of the leg of FIG. 2 when forming a tight radius according to the present invention.
Figure 8B:
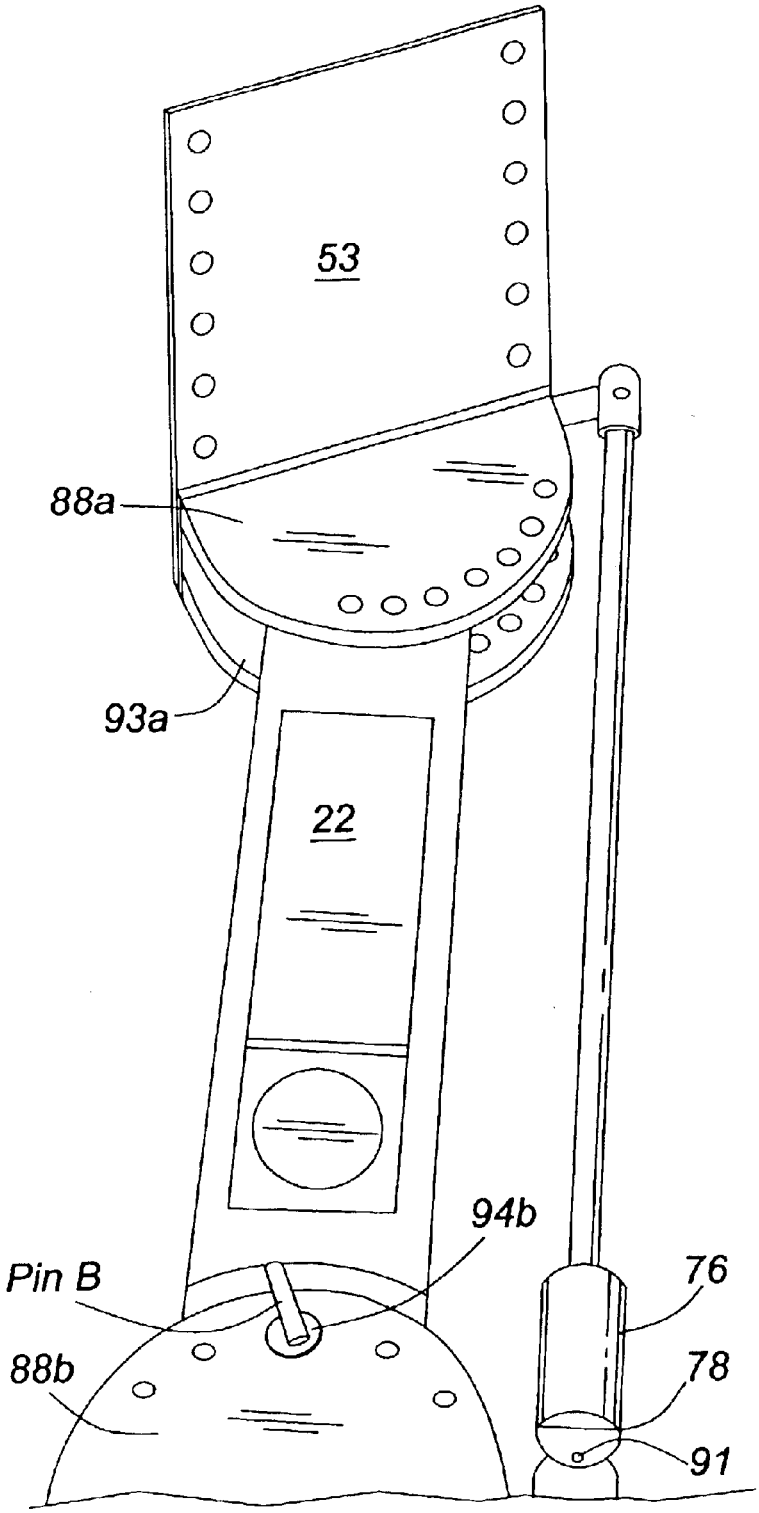
FIG. 8*b* illustrates a top view of FIG. 8*a;*

In order to achieve the tight radius position of FIGS. 8*a* and 8*b*, the locking pin A is removed, to allow leg portion 53 to rotate. Therefore, in addition to pivoting the track 49 about the leg 50, the leg 50 is pivotal relative to the main frame by extension and retraction of the shift cylinder 76. Relief valves (not shown) are provided for in the flow divider 99 to prevent any damage from one cylinder bottoming out before the other.

A pair of locking valves 102 is provided to prevent the cylinder 76, and therefore the leg assembly 50 and frame 22, from moving when there is no oil flow. Each valve has two inputs and two outputs. When oil from the pump (not shown) enters a first input, the oil goes through the locking valve to the cylinder. As oil enters one end of the cylinder, it exits the other end and the oil goes through the other side of the locking valve back to the pump. If oil enters the other input of the locking valve, then the oil will go through as before, only the cylinder will move in the opposite direction. If there is no oil flow to either input of the locking valve, the cylinder is locked in place even if there are external forces trying to force the cylinder rod to move in or out. This locking valve prevents the leg 50 from moving because locking pin A has been removed.

Figure 12:
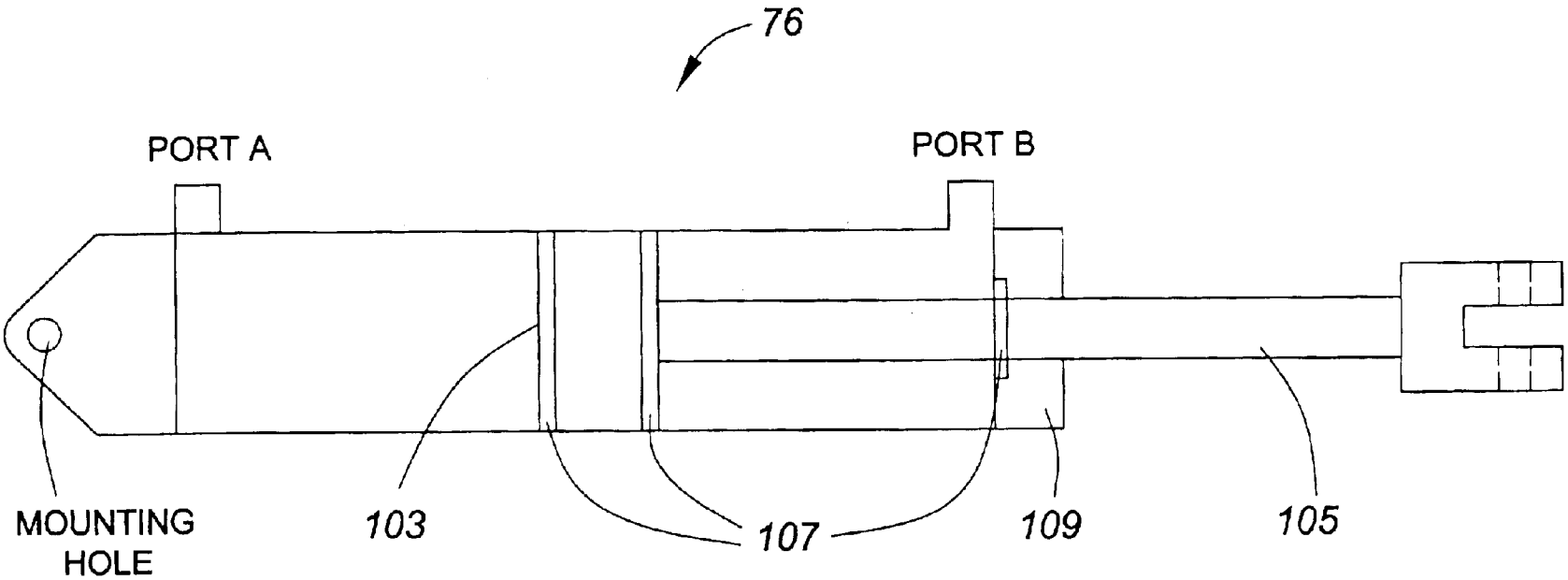
FIG. 12 illustrates the operation of a cylinder.

Referring to FIG. 12, the operation of a cylinder, for example cylinder 76, is shown. In operation as oil enters port A (at the cylinder end), the pressurized oil pushes the piston or ram 103 closer to port B. Oil on the other side of the piston is forced out of port B (at the rod end). The piston 103 can continue to move until it makes contact with the end cap 109. At this point, the rod 105 is fully extended. To retract the rod 105 into the cylinder, the opposite of above will occur. The rubber seals 107 prevent oil from leaking across the piston 103 or end cap 109.

Figure 13:
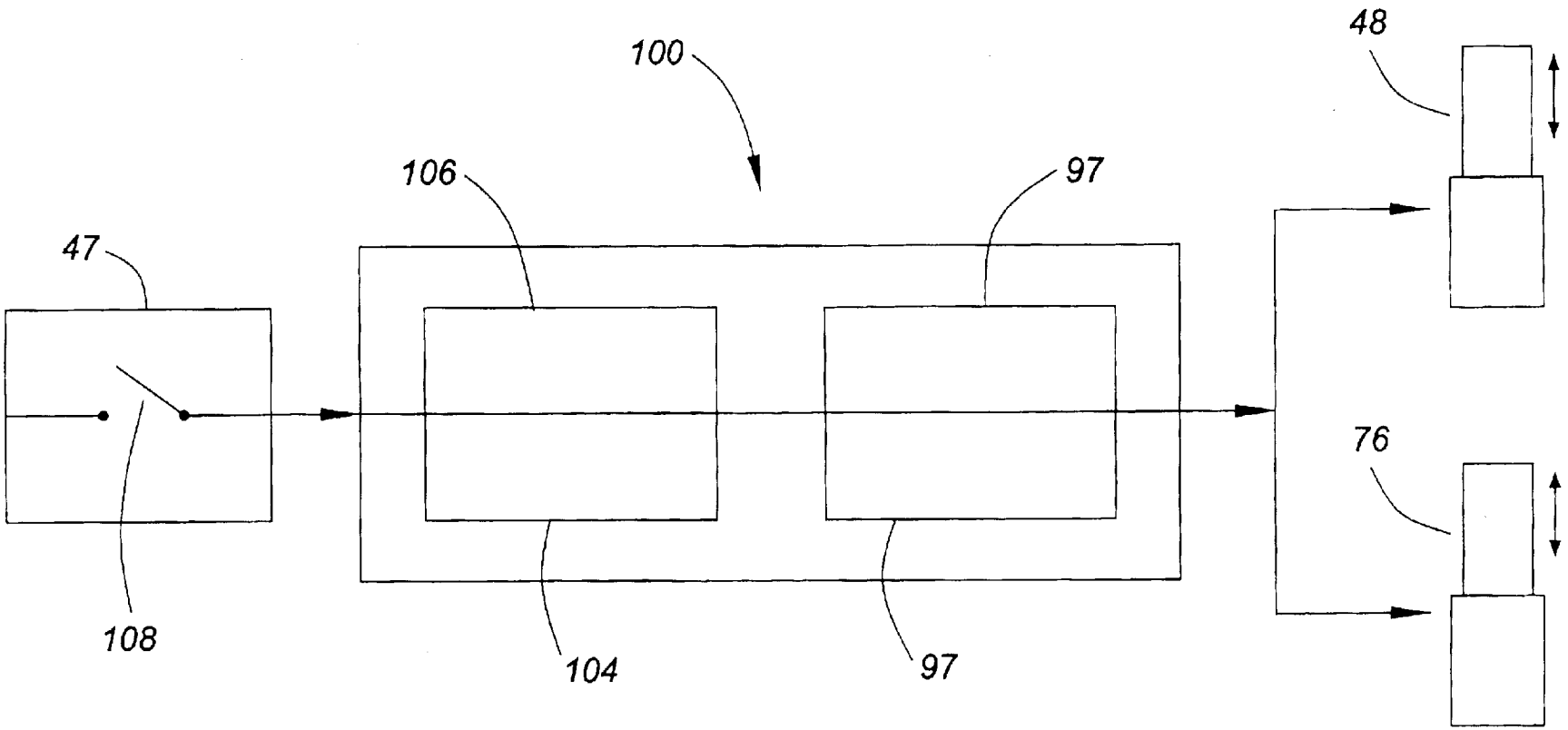
FIG. 13 is a block diagram of a controller according to the present invention.

Referring to FIG. 13, driver electronics 100 for circuit 90 is illustrated. Circuit 90 is operator-controlled via selector valves 97 that control the path of the oil within the hydraulic circuit 90. In turn, solenoids 104, 106 control the selector valves 97. An electric switch 108 in the cab 47, which is engaged or disengaged by the operator, controls the solenoid valves 104, 106. In this way, the hydraulic circuit 90 is operational between a first disengaged state wherein the hydraulic fluid is directed to actuate the steering cylinder 48 and shift cylinder 76 independently, and a second engaged state when the switch 108 is activated and the oil is diverted through the flow divider 99 to actuate both cylinders 48, 76.

In the first state, only the turning configuration of FIG. 6 is achievable, wherein the track 49 is pivotable about the leg 50 and the leg 50 is locked to the frame 22, which is locked to the frame 20 via Pins A and B.

In the second state, both cylinders 48, 76 extend or retract simultaneously and the shift cylinder 76 moves to the position seen in FIG. 8. This pivots the leg 50 relative to the frame and first front track 49 about the leg 50 to a position capable of forming tight radii, while the track 49 is pivotable about the leg 50.

Figure 14:
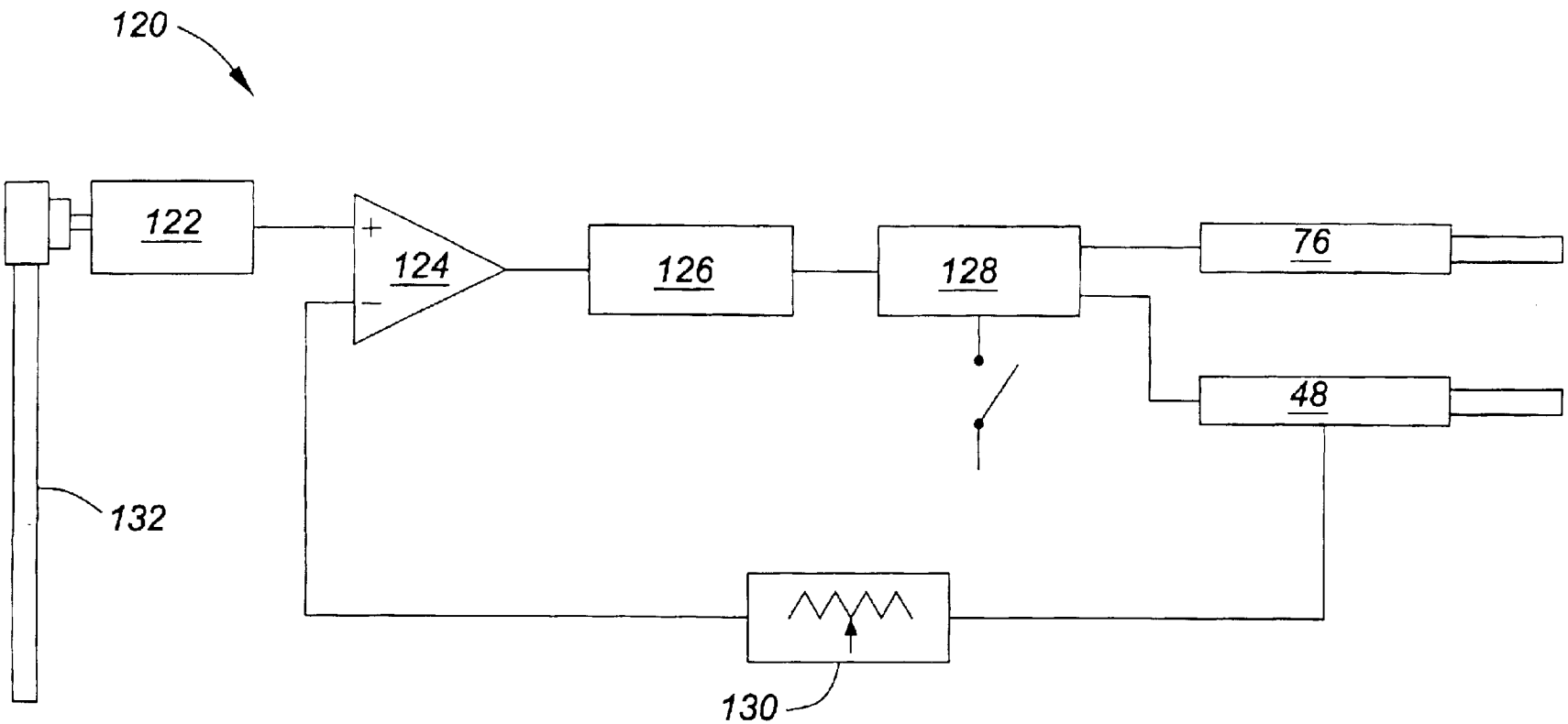
FIG. 14 is a block diagram of an electric steering system of the machine of FIG. 1 with a tight radius hydraulic circuit added.

The machine 20 is positioned as seen in FIG. 8 when tight radii are being formed. The electrical steering system 120 of FIG. 14 will allow the paving machine to correct itself when pouring larger radii and not automatically go into this position when the electric switch 108 is activated. The system consists of a steer sensor 122, differential amplifier 124, proportional servo valve 126, tight radius switching circuit 128, and a feedback position sensor or feedback pot 130. The steer system 120 is a proportional system, in that for every movement of the sensor wand 132, the track 49 turns a corresponding amount. The sensor 132 has a wand attached to its shaft, which is held firmly against the guideline by spring tension(not shown). As the machine frame moves left or right, in relation to a guideline (not shown), the wand causes the sensor shaft to rotate. As the shaft rotates, a corrective signal is sent to the amplifier 124. The amplifier 124 measures the amount and the direction of the signal from the sensor and conveys a corrective signal to the servo valve 126. The amount of servo valve 126 movement is in proportion to the amount of corrective signal. When the servo valve's spool shifts, pressurized oil is either routed to the rod or cylinder end of the cylinder causing the track to turn left or right. The more corrective signal the servo valve receives, the faster the track will turn. The feedback pot 130 is connected to the amplifier 124 to control how far the track 49 will turn for a given sensor movement. The feedback pot 130 measures the position of the track and sends a signal to the amplifier 124, indicating the track position. When the sensor 122 sends a corrective signal to the amplifier 124, the amplifier 124 in turn sends one to the servo valve 126. The servo valve 126 will direct oil flow to the appropriate end of the steer cylinder 48 to turn the track. As the track turns, an other signal is sent from the feedback pot 130 to the amplifier 124 where it is compared to the corrective signal from the sensor. The track 49 will continue to turn until the signal from both feedback pot 130 and sensor 122 are equal. At this point, the amplifier 124 will stop the corrective signal to the servo valve 126 and track 49 will stop moving. The two cylinders 48, 76 will act together only to the extent that the steer sensor 122 allows. So if the sensor 122 call for a small correction, then both cylinders 48, 76 move slightly. If the steer sensor 122 calls for a huge correction which is associated with a tight radius, then both cylinders 48, 76 will extent fully to correct the machine 20.

The hydraulic circuit 90 may further include a diode 111 to avoid any electrical damage to the machine's computers that can be caused by the collapsing magnetic field of the solenoids.

Figure 15:
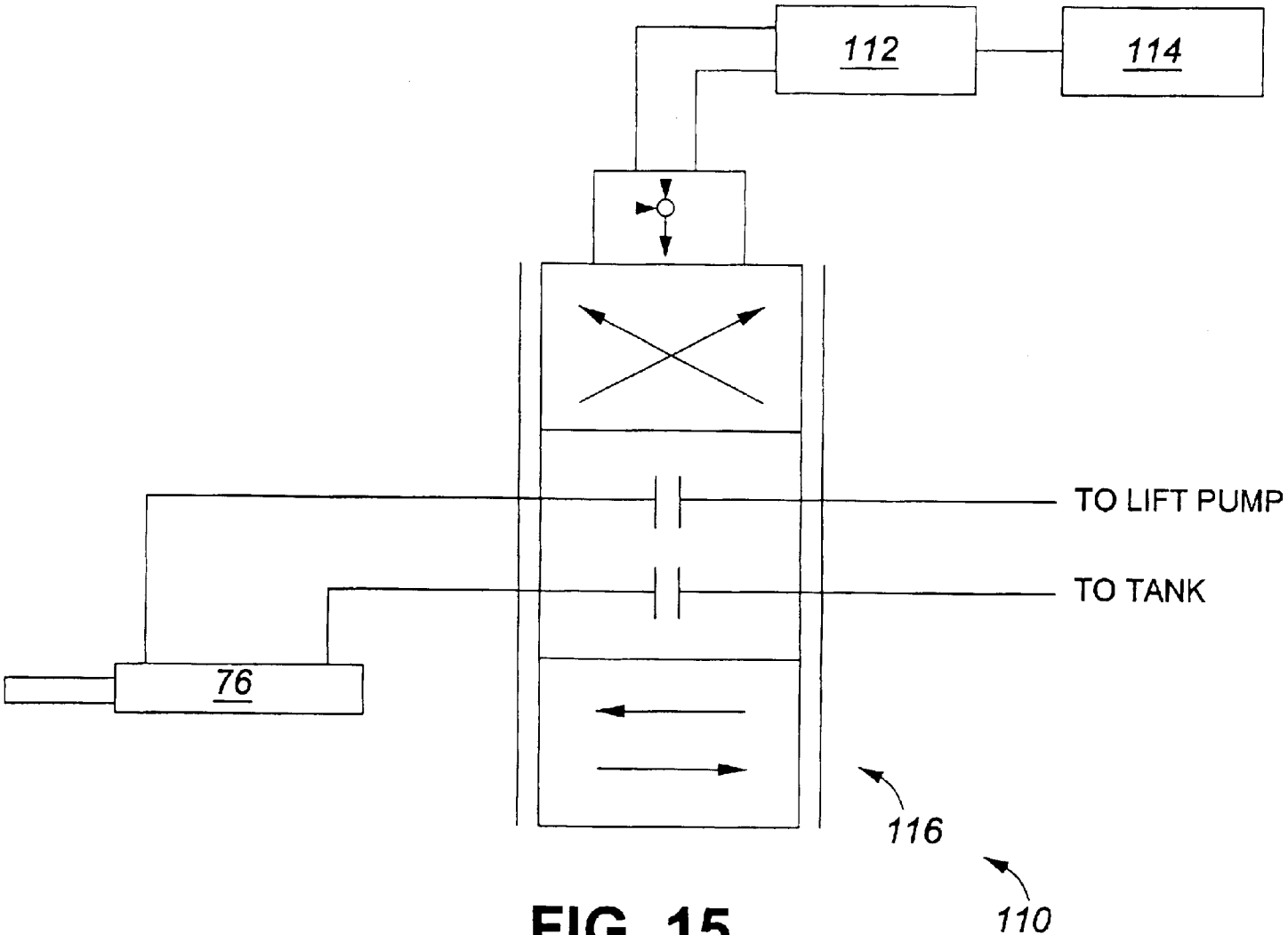
FIG. 15 illustrates another embodiment of a schematic of a hydraulic circuit that may be used to position a leg as seen in FIG. 8.

As an alternative, FIG. 15 illustrates another embodiment of the hydraulic circuit used to position leg assembly 24 in a tighter radius position. This alternative circuit 110 uses less space and generally weighs less. In operation, when the leg 50 needs to be positioned to form a tighter radius as seen in FIG. 8, the operator notifies the computer 112 via a button on the keypad in the operator's cab (not shown). The computer 112 then monitors the signal from the front steer sensor 114 to determine the appropriate time to activate the servo valve 116 to control the leg shift cylinder 76. As the machine tries to negotiate the tight radius, the front sensor 114 begins to move away from the guideline because the machine can not turn sharp enough to maintain the sensor wand in contact with the guideline. The computer senses this because the error signal from the steer sensor is not changing or increasing. If the machine could turn sharp enough, then the error signal would begin to decrease as the machine moved closer to the guideline. As the error signal for the steer sensor 114 increases, the computer 112 knows that the machine is not capable of negotiating the radius under normal condition so it sends a correction signal to the servo valve 116. This signal activates the servo valve 116 so it routes pressurized oil to cylinder end 78 of the leg shift cylinder 76 causing the cylinder rod to push the front leg 50 counter clockwise (as seen in FIGS. 8*a* and 8*b*). This turns the track to the position of FIG. 8 that enables the machine 20 to turn a sharper radius. As a result, the steer sensor 114 begins to return to the guideline and the error signal decreases. As the error signal decrease, so does the correction signal to the servo valve 116 thus reducing oil flow to the leg shift cylinder 76 which reduces its movement. Eventually there is no error signal from the steer sensor 114 and the machine 20 continues negotiating the tight radius.

When the machine 20 reaches the end of the radius, the steer sensor 114 begins to move closer to the guideline. An error signal is produced in the opposite direction. The computer 112 senses the error signal and sends a correction signal to the servo valve 116 which routes pressurized oil to the rod end 82 of the leg shift cylinder 76 (as seen in FIG. 11). This retracts the rod into the cylinder and causes the front leg 50 to turn clockwise, which aligns the track back to its normal operating position. Eventually there is no error signal from the steer sensor and the front leg 50 is back in its original position. At this point the operator notifies the computer 112 that the radius has been completed so the computer will disable the servo valve 116. This way the machine will operate as normal. Any manual adjustments to the leg shift cylinder 76 can be done on the computer 112 via manual override buttons (not shown). In this embodiment, the locking valve is built into the servo valve 116.

Numerous modifications may be made without departing from the spirit and scope of the invention as defined in the appended claims.

What is claimed is:

1. A system for use in a curb forming machine to allow the machine to form curbs having a tight radius, the curb forming machine having a frame;

at least three leg assemblies for supporting the machine, each leg assembly having a leg and a track mounted to the leg;

a hopper carried by the frame, the hopper including an opening for receiving curb forming material;

a slipform in communication with the hopper for receiving the curb forming material from the hopper for forming a curb, the system comprising;

a positioning arrangement for positioning a leg assembly on a forward end of the machine, the leg assembly adapted to form a tight radius, the positioning arrangement including means to rotate the track about the leg; means to rotate the leg relative to the frame about a vertical axis; a hydraulic circuit; and means to activate the hydraulic circuit, the hydraulic circuit being in fluid communication with the means to rotate the track about the leg and the means to rotate the leg relative to the frame;

wherein the means to rotate the track about the leg is a steering cylinder and the means to rotate the leg relative to the frame is a shift cylinder;

wherein activation of the hydraulic circuit actuates the steering cylinder to rotate the track about the leg, and actuates the shift cylinder to rotate the leg relative to the frame;

wherein the shift cylinder comprises a cylinder end pivotally mounted to the frame and a rod end pivotally mounted to the leg assembly, such as to rotate the leg assembly relative to the frame to position the corresponding leg assembly to form tight radii; and wherein the hydraulic circuit is in fluid communication with each cylinder, the circuit being operational between a first disengaged state in which the hydraulic fluid is directed independently to the steering cylinder and shift cylinder to rotate the track about the leg, and a second engaged state in which the hydraulic fluid is diverted through a flow divider for delivery to the steering cylinder and the shift cylinder respectively to rotate the corresponding track about the leg and the leg relative to the frame simultaneously to form tight radii.

2. The machine of claim 1, wherein in the second engaged state, hydraulic fluid is directed evenly between the cylinders to ensure smooth operation.

3. The machine or claim 1, wherein the positioning arrangement further comprises a locking pin for locking the position of the leg assembly with respect to the frame.

4. The machine of claim 1, wherein the means to activate the hydraulic circuit comprises a switch located in a cab of the paving machine.

5. In a curb forming machine comprising a frame with at least three leg assemblies for supporting the machine, each leg assembly having a leg and a track mounted to the leg; a hopper carried by the frame, the hopper including an opening for receiving curb forming material; and a slipform in communication with the hopper for receiving the curb forming material from the hopper for forming a curb, a method of enabling a leg assembly to form a tight radius, the method comprising the step of:

providing a positioning arrangement for positioning a front leg assembly to form a tight radius, the positioning arrangement including means to rotate the track about the leg;

providing means to rotate the leg relative to the frame about a vertical axis;

providing a hydraulic circuit having means to activate the hydraulic circuit, the circuit being in fluid communication with the means to rotate the track about the leg and the means to rotate leg relative to the frame;

wherein the means to rotate the track about the leg is a steering cylinder and the means to rotate the leg relative to the frame is a shift cylinder;

wherein activation of the hydraulic circuit actuates the steering cylinder to rotate the track about the leg, and actuates the shift cylinder to rotate the leg relative to the frame;

wherein the shift cylinder comprises a cylinder end pivotally mounted to the frame and a rod end pivotally mounted to the leg assembly, such as to rotate the leg assembly relative to the frame to position the corresponding leg assembly to form tight radii; and wherein the hydraulic circuit is in fluid communication with each cylinder, the circuit being operational between a first disengaged state in which the hydraulic fluid is directed independently to the steering cylinder and shift cylinder to rotate the track about the leg, and a second engaged state in which the hydraulic fluid is diverted through a flow divider to the steering cylinder and the shift cylinder to rotate the corresponding track about the leg and the leg relative to the frame simultaneously to form tight radii.

6. The method of claim 5, further comprising the step of locking the position of the leg assembly with respect to the frame with a locking pin.

7. The method of claim 5, wherein the hydraulic circuit is actuated by actuating a switch located in a cab of the paving machine.

* * * * *

UNITED STATES PATENT AND TRADEMARK OFFICE

CERTIFICATE OF CORRECTION

PATENT NO. : 6,890,123 B2
DATED : May 10, 2005
INVENTOR(S) : Mario Piccoli

It is certified that error appears in the above-identified patent and that said Letters Patent is hereby corrected as shown below:

Title page,
Item [73], Assignee, "N. Piccoli Construction, London (GB)" should read
-- N.Piccoli Construction, London (CA) --.

Signed and Sealed this

Thirtieth Day of August, 2005

JON W. DUDAS
*Director of the United States Patent and Trademark Office*